United States Patent [19]

Maloney et al.

[11] 4,146,110

[45] Mar. 27, 1979

[54] SPEAKER APPARATUS

[75] Inventors: Brian J. Maloney, St. Charles; Richard S. Cox, Hoffman Estates, both of Ill.

[73] Assignee: Motorola, Inc., Schaumburg, Ill.

[21] Appl. No.: 913,912

[22] Filed: Jun. 7, 1978

[51] Int. Cl.[2] ..... H04R 1/24

[52] U.S. Cl. ..... 181/147; 179/115.5 PS

[58] Field of Search ..... 179/115.5 PS; 181/144, 181/147

[56] References Cited

U.S. PATENT DOCUMENTS 1,180,147 4/1916 Hatch ..... 179/102

*Primary Examiner*—George G. Stellar

*Attorney, Agent, or Firm*—Melvin A. Klein; James W. Gillman

[57] ABSTRACT

A speaker apparatus which has a main speaker and at least one tweeter speaker in which a wire bridge member is used to support the tweeter speaker relative to the main speaker at a predetermined position therefrom. The wire bridge member is retained between the tweeter speaker and the tweeter speaker cover by pins which are heat staked. The wire bridge member has a circular center portion to accommodate the tweeter speaker and arm portions extending transversely and then inwardly at right angles for securing to the main speaker.

6 Claims, 3 Drawing Figures

SPEAKER APPARATUS

BACKGROUND OF THE INVENTION

This invention relates generally to an improved speaker apparatus and in particular to a speaker apparatus having a main speaker and at least one tweeter speaker in overlying relation thereto.

In the past it has been known to assemble a main speaker and a tweeter speaker in a combined assembly by the use of sheet metal parts secured by rivets, nuts and bolts and washers. A problem associated with the sheet metal configuration has been blockage of the main speaker. Furthermore, the fastening parts have been known to vibrate and loosen and thereby cause a disturbance which detracts from the quality of the speaker assembly.

SUMMARY OF THE INVENTION

It is therefore an object of the present invention to improve speaker apparatus.

It is a further object of the invention to provide for rapid assembly of speaker apparatus which includes a main speaker and a tweeter speaker.

It is still a further object of the invention to eliminate separate fastening elements from the construction of speaker apparatus including a main speaker and a tweeter speaker.

It is still a further object of the present invention to minimize sound distortion of a speaker apparatus which includes a main speaker and a tweeter speaker in overlying position thereto.

It is still a further object of the present invention to provide a simplified construction of a speaker apparatus including a main speaker and a tweeter speaker in overlying relation thereto.

It is still a further object of the invention to reduce the number of parts in the assembly of a speaker apparatus.

It is still a further object of the invention to facilitate the assembly of speaker apparatus to greatly reduce the cost thereof.

The speaker apparatus of the present invention generally speaking is accomplished by the use of a wire bridge which supports the tweeter speaker in such a manner that there is minimal blockage of the main speaker. More than this, by virtue of the unique construction and assembly of the wire bridge, tweeter speaker and main speaker the use of conventional separate fastening members is eliminated from the assembly.

DESCRIPTION OF THE DRAWINGS

For a more complete understanding of the invention reference is made to the accompanying drawing in which.

DESCRIPTION OF THE PREFERRED EMBODIMENT

Figure 1:
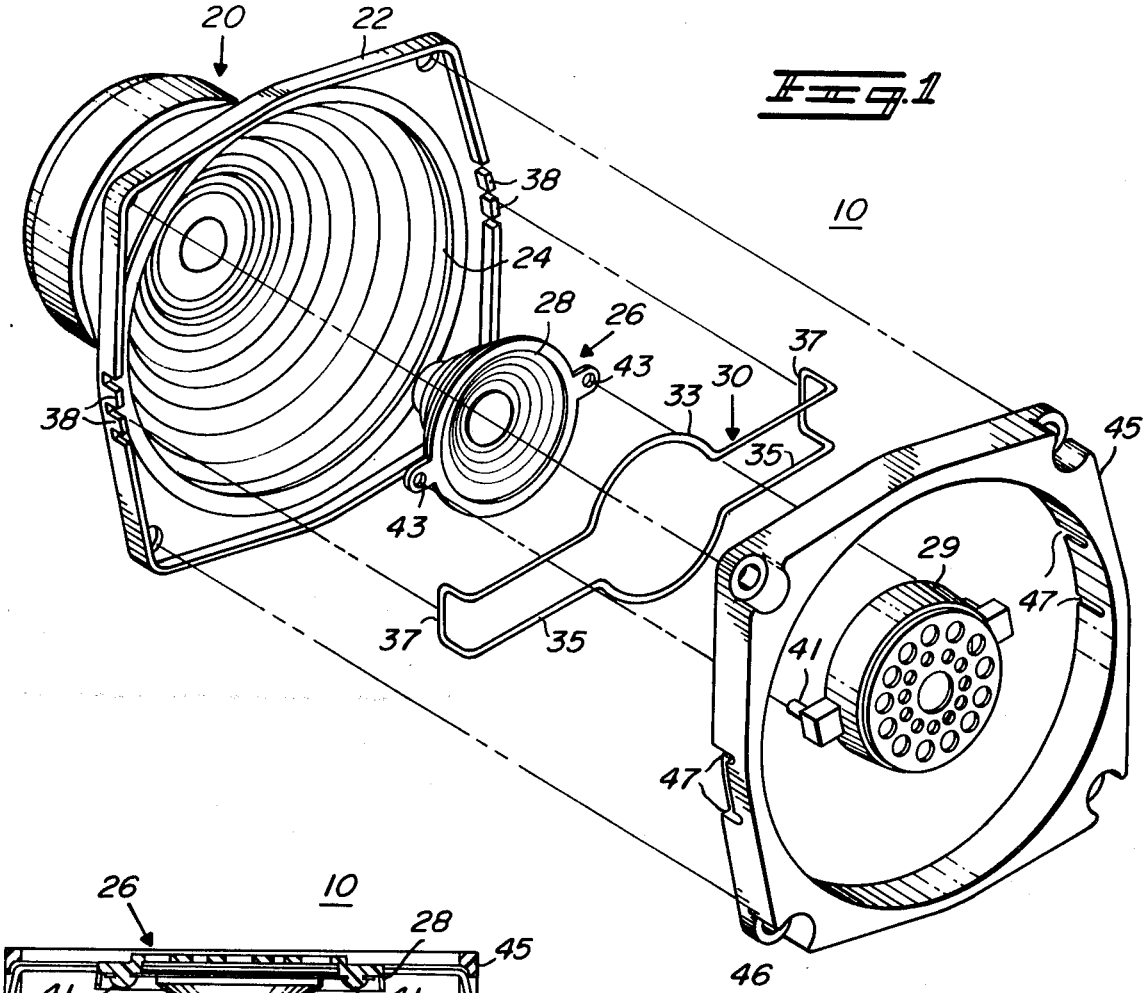
FIG. 1 is an exploded perspective view of the improved speaker apparatus according to the present invention.
Figure 2:
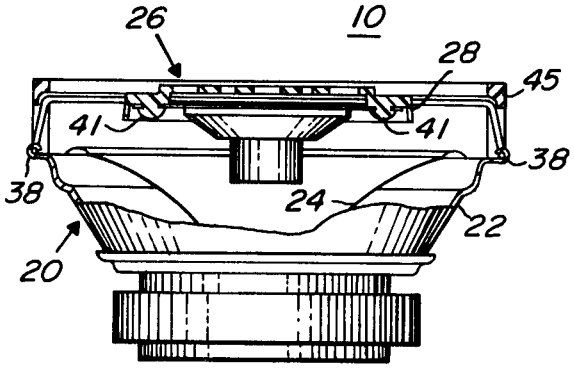
FIG. 2 is a sectional view of the improved speaker apparatus of the present invention illustrating details thereof.

Referring to FIGS. 1 and 2 of the drawings there is shown the improved speaker apparatus of the invention generally designated as 10 which includes a main speaker assembly 20 having a main speaker basket 22 and a movable main speaker cone 24 and a tweeter speaker assembly 26 which includes tweeter speaker 28 and tweeter speaker cover 29.

In accordance with the present invention the tweeter speaker assembly 26 is secured in overlying relation in front of the movable cone 24 of main speaker assembly 20 in such a manner to minimize any blockage of the main speaker assembly as will become more apparent. Furthermore, the speaker assemblies are secured without the use of separate fasteners. A wire bridge member 30 is formed with a generally circular portion 33 at the mid-section thereof to accommodate the tweeter speaker 28. Wire bridge member 30 also includes arm portions 35 which extend transversely and then turn at right angles at end portions 37 for engagement by the main speaker basket 22. Basket 22 is formed with tab members 38 for engaging end portions 37. It will be noted that the end portions 37 extend a predetermined distance sufficient to space the tweeter speaker assembly 26 from interfering with the movable cone 24 of main speaker assembly 20 during operation. Also end portions 37 provides support and reinforcement for the tweeter speaker assembly.

The tweeter speaker assembly 26 is secured to the wire bridge member 30 and main speaker assembly in the following manner. Tweeter cover 29 is formed with pins 41 and tweeter speaker 28 is formed with apertures 43 therein. After positioning the wire bridge member between speaker 28 and cover 29 pins 41 are inserted into apertures 43 and then heat staked. It will now be appreciated that the tweeter speaker assembly 26 is firmly secured to the main speaker assembly 20 without the use of nuts, bolts, screws or washers or any other separate fastening devices which can vibrate and become loosened through the operation of the speaker assembly. By virtue of the open area of the wire bridge member there is minimal blockage of the sound emanating from the cone 24 of main speaker assembly 20.

To complete the speaker assembly a gasket member 45 is positioned in front of the wire bridge member 30 and secured to the main speaker assembly 20 in any suitable manner as by an adhesive. Openings 46 are provided for mounting purposes. The gasket member 45 is formed with grooves 47 to accommodate the bridge member 30 in the vicinity of arm portions 35 and end portions 37. It will be noted that the distance or height of the gasket member 45 extends sufficiently beyond the height of the tweeter assembly 26 in order to protect the tweeter assembly from damage through impact. A flexible cover (not shown) usually made of a fine meshed material is placed over the gasket member for protection and decoration of the speaker assemblies.

Figure 3:
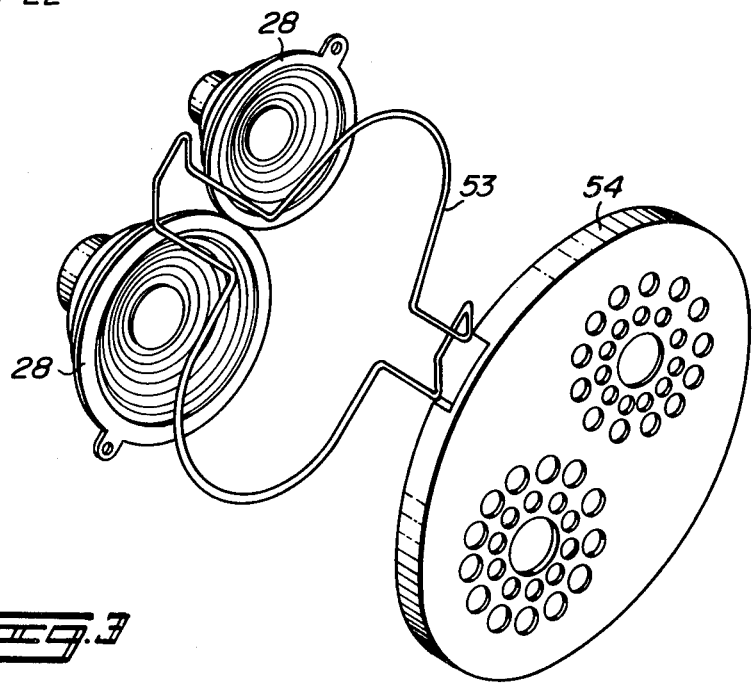
FIG. 3 is a perspective view of another wire bridge member and multiple tweeter speakers in a second embodiment of the invention.

Referring now to FIG. 3 there is shown an alternate embodiment of the invention in which wire bridge member 50 is formed with an elongated center portion 53 to accommodate a plurality of tweeter speaker assemblies 28 and enlarged cover 54.

By the above described invention there is an improved speaker apparatus having a main speaker with movable cone and tweeter speaker arranged in overlying position at a predetermined distance from the movable cone to prevent interference. Also by virtue of the unique construction of the wire member there is minimal blockage of the main speaker assembly. Furthermore, the speaker assemblies are secured without the conventional hardware fasteners.

While particular embodiments of the invention have been shown and described, it should be understood that the invention is not limited thereto since many modifications may be made. It is therefore contemplated to cover by the present application any and all such modifications that fall within the true spirit and scope of the basic underlying principles disclosed and claims herein.

What is claimed is:

1. In a speaker apparatus having a main speaker and associated movable cone and a tweeter speaker overlying said movable cone the improvement comprising:

a wire bridge member supporting said tweeter speaker at a predetermined position from the movable cone of the main speaker, said wire bridge member having a center portion for receiving said tweeter speaker and arm portions extending laterally from said center portion and spaced at a predetermined distance in front of said movable cone so as not to interfere therewith during operation thereof, and cover means including fastening means for securing said cover means, wire bridge member and tweeter speaker together.

2. Apparatus according to claim 1 wherein said fastening means comprises heat staked pin members received through openings in said tweeter speaker.

3. Apparatus according to claim 1 wherein said arm portions have end portions extending at right angles thereto, said end portions being secured to tab portions extending from said main speaker.

4. Apparatus according to claim 1 including a gasket member mounted on said main speaker, said gasket member being formed with grooves for receiving said arm and end portions of said wire bridge member.

5. Apparatus according to claim 4 wherein the height at which said gasket member extends beyond the main speaker is greater than the height said tweeter speaker extends beyond said main speaker.

6. Apparatus according to claim 1 including a plurality of tweeter speakers supported by said wire bridge member.

* * * * *